US009567828B2

(12) United States Patent
Kniffin et al.

(10) Patent No.: US 9,567,828 B2
(45) Date of Patent: Feb. 14, 2017

(54) APPARATUS AND METHOD FOR SEALING A PORTION OF A COMPONENT DISPOSED IN A WELLBORE

(76) Inventors: Glen Mitchell Kniffin, Centennial, CO (US); John David Harkrider, Greenwood Village, CO (US); William Lee Anthony, Colorado Springs, CO (US); Jeff S. Jordan, Centennial, CO (US)

( * ) Notice: Subject to any disclaimer, the term of this patent is extended or adjusted under 35 U.S.C. 154(b) by 763 days.

(21) Appl. No.: 13/359,497

(22) Filed: Jan. 27, 2012

(65) Prior Publication Data

US 2013/0192828 A1 Aug. 1, 2013

(51) Int. Cl.
*E21B 33/138* (2006.01)
*E21B 33/12* (2006.01)

(52) U.S. Cl.
CPC ..... *E21B 33/138* (2013.01); *E21B 33/1208* (2013.01)

(58) Field of Classification Search
CPC ..... E21B 33/13; E21B 33/138; E21B 33/1208
USPC ..... 166/284, 285, 292
See application file for complete search history.

(56) References Cited

U.S. PATENT DOCUMENTS

| | | | | |
|---|---|---|---|---|
| 2,627,925 A * | 2/1953 | Scivally | ..... | 166/173 |
| 4,102,401 A * | 7/1978 | Erbstoesser | ..... | 166/284 |
| 5,253,709 A * | 10/1993 | Kendrick et al. | ..... | 166/284 |
| 8,714,250 B2 * | 5/2014 | Baser et al. | ..... | 166/284 |

* cited by examiner

*Primary Examiner* — Robert E Fuller

(57) ABSTRACT

An apparatus and method for substantially sealing an opening defined by a hydrocarbon well downhole component, wherein an interior portion of the downhole component is in fluid communication with a formation surrounding the hydrocarbon well. The apparatus includes a deformable plug adaptable to being injected into the wellbore upstream of the opening and carried through the wellbore in a fluid. The fluid carrying the deformable plug can flow through the opening and the deformable plug is sized and configured such that at least a portion of the deformable plug can deform to the contour of the opening and seat in the opening. The deformable plug is capable of swelling, hardening, or compressing such that the deformable plug forms a substantially sealed relationship with the hydrocarbon well downhole component such that the interior portion of the downhole component ceases to be in fluid communication with the formation surrounding the well.

12 Claims, 5 Drawing Sheets

APPARATUS AND METHOD FOR SEALING A PORTION OF A COMPONENT DISPOSED IN A WELLBORE

CROSS-REFERENCE TO RELATED APPLICATIONS

None

FIELD

The present invention relates to an apparatus and method for sealing a portion of a component disposed in a wellbore within a subterranean formation. More specifically, the invention relates to an apparatus and method for substantially sealing a portion of a component disposed in the wellbore of a hydrocarbon well, wherein the portion of the component is adjacent to and in fluid communication with a hydrocarbon production zone within a subterranean formation.

BACKGROUND

Myriad wells have been drilled into earth strata for the extraction of oil, gas, and other material there from. Typically, hydrocarbon wells are constructed by setting a string of pipe, commonly referred to as casing, in the wellbore and filling the space (annulus) between the wellbore and outer surface of the casing with cement. Completing a well in this manner allows for the flow of fluid from the surrounding formation to the well to be limited to selected zones. In order to permit fluid flow between the formation and well, the operator of the well will identify the particular strata where fluid will be injected and/or from which the hydrocarbons will be collected, and then will perforate the casing and cement at the appropriate location. The perforations may be created by bullets or jet shots discharged from a conventional perforating gun at high pressure and can extend through the walls of the casing and the cemented area such that the selected strata, referred to as the production zone, is in fluid communication with the interior portion of the casing in the well. Alternatively, holes may be cut through the pipe and cement by hydro-jetting. Some well constructions do not place cement in the annular space and are referred to as un-cemented completions. Sections of the un-cemented annulus may be segregated with external casing packers. Perforations or sliding sleeve assemblies are used to communicate the selected strata with the interior portion of the casing in the well. In the case of sliding sleeve assemblies, the sleeves are shifted open exposing a port to gain access to the formation.

After completing the well, the production zone of the formation may be treated to increase the flow of hydrocarbons into the well. Typically, a well may be fractured in the event the formation in the production zone is characterized by low permeability. The well may be fractured by a conventional manner, one such example being hydraulic fracturing. To hydraulically fracture a well, a fluid such as water containing a particulate material such as sand is pumped down under high pressure from the surface into the casing and out through the perforations, jetted holes or ports into the production zone to break the formation creating fractures. The particulate material lodges in the fractures and serves to "prop" the fractures open, thus increasing the permeability of the production zone and further increasing fluid flow into the well when the well is put on production.

One conventional manner of improving the results of the fracturing procedure is to ensure that the treating fluid is injected into the production zone with a fairly even flow distribution in all directions. However, achieving an even distribution can be difficult, because the formations in the production zone may not be of equal stress. The treating fluid will preferentially flow to the areas of least resistance, i.e., the areas of lowest stress, and high stress areas will receive correspondingly reduced flow rates. This problem can become especially acute when the production zone is long or there are a large number of perforations.

One method used to address this flow imbalance problem is the redirection of the treating fluid toward higher stress zones by using ball sealers to temporarily block perforations that exist across lower stress zones. These ball sealers are typically spherical in shape and have a diameter that is larger than the average perforation size, and are pumped into the casing along with the treating fluid. The flow pattern of the fluid preferentially carries the ball sealers toward the casing perforations that have the highest flow rate of fluid passing into the production zone. The ball sealers seat upon the perforations receiving the majority of fluid flow and, once seated, are held there by the pressure differential across the perforations. If a substantial number of the high flow perforations are blocked by ball sealers seated against them, then fluid flow can be diverted to the perforations which had relatively low flow rates, which can fracture the formation, thus increasing the flow capacity of the production zone. A more even flow distribution may be achieved and, as a result, the increase in hydrocarbon recovery can be larger than it would be if the flow imbalance was not corrected.

As mentioned above, the ball sealers may be pumped into the casing and transported by the treating fluid. Typically, no additional treatment equipment is required other than a ball injector and, optionally, a ball catcher. Advantages of utilizing ball sealers to divert flow of the treating fluid include ease of use, positive shutoff, no involvement with the formation, and low risk of incurring damage to the well. Generally, ball sealers are designed to be chemically inert in the environment to which they are exposed; to effectively seal, yet not extrude into the perforations. The ball sealers can be released from the perforations when the pressure differential into the formation is relieved, fluid flow is commenced into the casing, or alternatively can be physically removed from the perforation by contact with a weighted bar or gauge ring run on a pipe string or wireline. Some ball sealers are designed to dissolve with time and temperature. Such ball sealers are termed "biodegradable ball sealers."

As the hydrocarbons flow into the well, the production zone depletes over time and it can be desirable to tap deposits that are trapped within the formation, either in existing production zones or new production zones. This can include fracturing the existing formation again, or optionally adding additional perforations and selectively treating the new perforations. However, treating a new production zone can be difficult without isolating the new untapped production zone from the existing production zone. Alternatively, there may be so many perforations and/or an exceedingly long perforated interval that the whole interval cannot be effectively contacted with a re-fracturing treatment. As will be appreciated by those skilled in the art, there are multiple conventional techniques available by which to isolate or seal the perforations associated with the existing production zone and thereby block communication with the wellbore.

One convention procedure utilizes pumping cement to seal the existing perforations, drilling out the cement from the casing, perforating and re-fracturing the well. However, the conventional procedures utilizing pumping cement to seal the existing perforations can be disadvantageous. The cement not only seals the casing but also can fill the fractures within the formation and can damage the near wellbore formation. Utilization of a workover rig to pump the cement and, optionally, drilling the cement out can be time consuming and expensive, thus undesirably reducing the efficiency by which the hydrocarbons can be obtained.

Another conventional procedure for sealing the perforations associated with the existing production zone and thereby blocking communication with the wellbore includes running a liner into the wellbore. This procedure involves hanging several hundred to several thousand feet of pipe (liner) inside the existing wellbore to cover the production zone and setting the liner in place. Optionally, an expandable liner may be inserted in the wellbore, wherein the liner expands to the inner diameter of the casing. However, the solution of adding a liner suffers from the problem of high cost for many feet of extra steel and has the additional complexity of hanging the liner in the hole, especially in lateral boreholes commonly found in horizontally developed shale plays. Additionally, the liner job also decreases the inside diameter of the wellbore, which can hinder future ability to work on the well.

As discussed above, conventional ball sealers may be injected into the wellbore to seal off perforations in the production zone. However, such ball sealers only temporarily seal off the perforations and typically the sealing relationship with the perforations is lost when the pressure differential across the perforations is lost due to the elimination of the treating fluid flow and/or the release of pressure. Furthermore, the effectiveness of the conventional ball sealers is limited by the flow rate of the treating fluid pumped into the wellbore. For example, in a typical lateral borehole, the flow rate of the treating fluid may be a maximum of one hundred barrels per minute. Such a flow rate may only result in a quarter to a little more than a third of the production zone sealed off in a lateral borehole as those typically drilled in horizontal shale plays.

In view of the above, it would be desirable to employ an inexpensive and time-efficient method to substantially seal off a production zone of a hydrocarbon well. It would further be desirable to substantially seal off a production zone utilizing a minimal amount of hardware and machinery, such that transport cost and time to the well site would be minimized. It would also be desirable to employ a method to substantially seal off a production zone utilizing fewer trained operators than traditionally needed in other conventional procedures. In addition, it would be desirable to employ a method to substantially seal off a production zone that does not damage and/or contaminate the surrounding formation. Furthermore, it would be desirable to employ a method of substantially and permanently sealing off a production zone in a horizontal wellbore in a horizontal shale play without damaging and/or contaminating the surrounding formation.

SUMMARY

An embodiment of the present invention is an apparatus for substantially sealing an opening defined by a hydrocarbon well downhole component, wherein an interior portion of the downhole component is in fluid communication with a formation surrounding the hydrocarbon well, the apparatus includes a deformable plug adaptable to being injected into the wellbore upstream of the opening and carried through the wellbore in a fluid. The fluid carrying the deformable plug can flow through the opening and the deformable plug being sized and configured such that at least a portion of the deformable plug can deform to the contour of the opening and seat in the opening. The deformable plug is capable of hardening, swelling, or compressing such that the deformable plug forms a substantially sealed relationship with the hydrocarbon well downhole component such that the interior portion of the hydrocarbon well downhole component ceases to be in fluid communication with the formation surrounding the well.

The deformable plug can have a composition selected from the group consisting of polymers, syntactic foam, malleable metal alloy, organic material, and combinations thereof, and the deformable plug can have a density of about 0.7 g/cc to about 1.3 g/cc and an outer diameter of about 0.5 inches to about 1.5 inches.

The deformable plug can have a composition selected from the group consisting of polymers, syntactic foam, malleable metal alloy, organic material, and combinations thereof, wherein the composition is capable of swelling, hardening, or compressing in response to an external condition such that the seated portion of the deformable plug can be projected against and abut the contour of the opening defined by the hydrocarbon well downhole component thereby forming a substantially sealed relationship with the hydrocarbon well downhole component.

The hydrocarbon well component can be selected from the group consisting of casing, tubing, and liner. The hydrocarbon well component can be casing and the opening defined by the casing can be a perforation formed from the discharge of a perforation tool. The fluid carrying the deformable plug can have a density less than the density of the deformable plug.

An embodiment of the present invention is a system for substantially sealing one or more openings defined by a hydrocarbon well downhole component, where an interior portion of the downhole component is in fluid communication with a formation surrounding the hydrocarbon well, the system including the apparatus described above and a deformable plug injector sized and configured to inject a plurality of deformable plugs into the hydrocarbon well downhole component and a fluid pumping source sized and configured to pump the fluid at a sufficient rate to carry the plurality of deformable plugs downhole so that one or more of the plurality of deformable plugs can seat in the opening defined by the hydrocarbon well component and form a substantially sealed relationship with the hydrocarbon well downhole component.

The system can include a ball catcher sized and configured to retrieve one or more deformable plugs in the wellbore.

An embodiment of the present invention is a method for substantially sealing at least one opening defined by a hydrocarbon well downhole component, wherein an interior portion of the hydrocarbon well downhole component is in fluid communication with a formation surrounding the hydrocarbon well, the method including injecting at least one deformable plug into the interior portion of the hydrocarbon well downhole component and pumping a fluid from a fluid pumping source into the interior portion of the hydrocarbon well downhole component, such that the fluid carries the deformable plug as the fluid flows through the opening and the deformable plug seats in the opening defined by the hydrocarbon well downhole component, at least a portion of the deformable plug (i) deforming to abut substantially all of the contour of the opening, and (ii)

rigidly setting in a substantially sealing relationship with the hydrocarbon well downhole component such that interior portion of the hydrocarbon well downhole component and the formation surrounding the wellbore are no longer in fluid communication.

The deformable plug can have a composition selected from the group consisting of polymers, syntactic foam, malleable metal alloy, organic material, and combinations thereof, and the deformable plug has a density of about 0.7 g/cc to about 1.3 g/cc and an outer diameter of about 0.5 inches to about 1.5 inches.

The deformable plug swells, hardens, or compresses in response to an external condition such that the seated portion of the deformable plug is projected against and abuts the contour of the opening defined by the hydrocarbon well downhole component thereby forming a substantially sealed relationship with the hydrocarbon well downhole component.

The method can include severing the portion of the deformable plug extending into the interior portion of the hydrocarbon well downhole component such that the inner diameter of the hydrocarbon well downhole component is substantially uniform.

The various aspects of the present invention can be joined in combination with other aspects of the invention and the listed embodiments herein are not meant to limit the invention. All combinations of aspects of the invention are enabled, even if not given in a particular example herein.

DETAILED DESCRIPTION

The present invention is related to an apparatus and method for substantially sealing a portion of a component disposed in the wellbore of a hydrocarbon well, wherein the portion of the component is adjacent to and in fluid communication with a production zone including one or more hydrocarbon reservoirs. In an embodiment, the apparatus includes a deformable plug sized and configured to substantially seal a portion of a component adjacent to a production zone of a hydrocarbon well. In an alternate embodiment, the deformable plug is sized and configured to substantially seal a perforation in the production zone of a hydrocarbon well. In yet another embodiment, the deformable plug is sized and configured such that a plurality of deformable plugs substantially seals an opening defined by the casing in the production zone. The aforementioned embodiments will be discussed in more detail below in addition to the Figures included herein.

Figure 1:
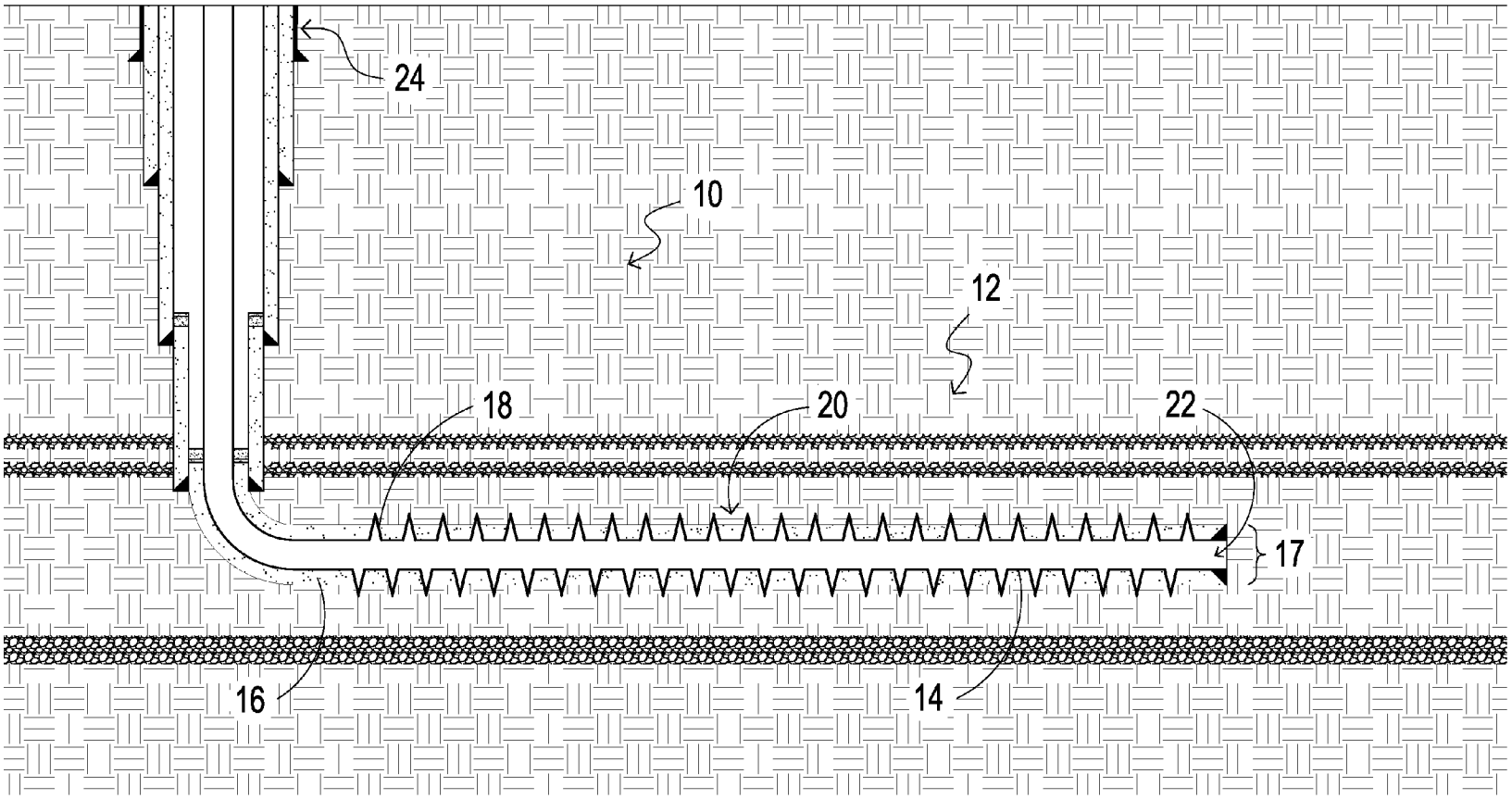
FIG. 1 illustrates a cross-sectional view of a wellbore prior to treatment with an embodiment of the present invention.

Turning now to the Figures, FIG. 1 illustrates a conventional hydrocarbon well (10) drilled into a target formation (12) and adaptable for treatment with the present invention. The hydrocarbon well includes multiple intervals of casing, wherein the inner diameter of each interval of casing adjacent to the formation decreases as the depth of the well increases. The smallest inner diameter casing, typically referred to as production casing (14), is disposed within the portion of the wellbore adjacent the target formation (12). The term "target formation" refers to the portion of the formation selected by the operator in which to pump fluids and/or the portion of the formation selected by the operator from which to collect hydrocarbons. The intervals of casing are each surrounded by cement (16) pumped into the space, referred to as the annulus, between the walls of the wellbore (17) and the outer walls of each interval of casing (14). Optionally, the production casing (14) may be completed without cement being pumped in the annulus. External casing packers may be installed on the production casing to provide for isolation between multiple stage fracture stimulation.

As illustrated in FIG. 1, the hydrocarbon well is a directionally drilled well. More specifically, the well as shown is a substantially horizontally drilled well in a formation, such as a shale formation. Directional drilling of wells in shale formations or other low permeability formations can be very beneficial in enhancing the recovery of hydrocarbons in such formations. It should be understood that although the present invention is effective in directionally drilled wells, the present inventions is not limited to such wells. The hydrocarbon well may include a substantially vertical wellbore. Optionally, the hydrocarbon well may include a lateral wellbore, wherein a portion of the wellbore is lateral of the longitudinal axis of the remaining portion of the wellbore.

The wellbore includes a plurality of openings (18) illustrated as perforations and defined by the casing (14), cement (16), and adjacent target formation (12) as illustrated in FIG. 1. The perforations are created in the target formation typically by a perforating gun or similar device and form a pathway connecting the wellbore and production zone in fluid communication. The size and configuration of the perforations are operator and formation specific and may vary depending on the formation characteristics and/or specifications desired by the operator. Typically, the perforations are less than one inch in diameter and extend into the formation when first formed by the discharge of the perforating gun. In an illustrative example the perforations can range from one foot to two feet into the formation. Although the perforations (18) are illustrated as equidistant, the arrangement of the perforations in the production zone (20) of the casing (14) can vary based on the specifications chosen by the operator. The term "production zone" as referred to herein refers to the portion of the selected strata, or target formation, in fluid communication with the interior portion of the wellbore component through one or more perforations created in at least the target formation and wellbore component disposed in the well. Optionally, as in the case of un-cemented completions, a sliding sleeve is opened and closed to gain access to the target formation. The sleeve can be actuated by pumping a ball down the well that lands on a seat and hydraulically shifts the sleeve open.

At least a portion of the hydrocarbons from the production zone (20) will flow through the perforations (18) into the interior portion (22) of the casing (14) due to the pressure differential between the production zone and the interior portion of the casing. As this occurs, the well (10) is said to be producing. The hydrocarbons (not shown) flowing out of the production zone (20) through the perforations (18) and into the wellbore (17), specifically the interior portion (22) of the casing, may be transported to the surface (24) through production tubing (not shown). An optional production packer (not shown) can be installed near the lower end of the production tubing and above the highest perforation in the production zone to achieve a pressure seal between the production tubing and the casing, if necessary. As shown in FIG. 1, production tubing is not always used and, in such cases, the entire interior portion (22) of the casing (14) is used to conduct the hydrocarbons to the surface (24) of the earth.

As the pressure is reduced in the production zone and/or the hydrocarbons in the production zone are depleted, fewer hydrocarbons will flow into the wellbore from the production zone until an economical limit is reached or the operator decides to plug the well or at least the existing production zone of the well. In an embodiment of the present invention, a method is provided for substantially sealing a portion of a component adjacent to a production zone of a hydrocarbon well. In another embodiment, an apparatus is provided for substantially sealing at least a portion of a component adjacent to a production zone of a hydrocarbon well. In yet another embodiment, one or more apparatus is provided for substantially sealing a perforation in the production zone. Substantial sealing of a perforation can be indicated by an increase in wellbore pressure as the deformable plug seals off a perforation.

Figure 2:
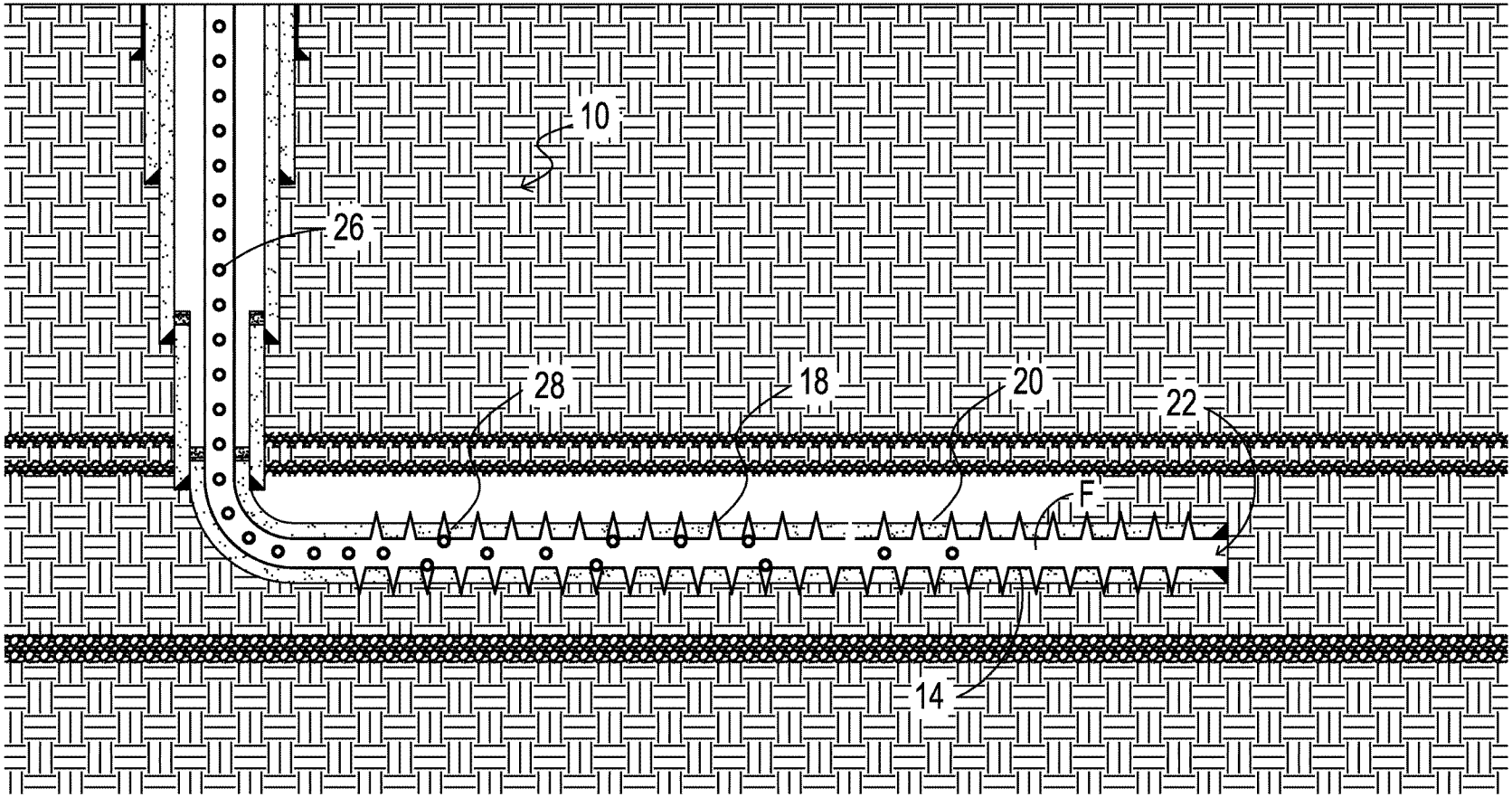
FIG. 2 illustrates a cross-sectional view of a wellbore injected with a plurality of deformable plugs consistent with an embodiment of the present invention.

Looking now at FIG. 2, an embodiment of the present invention is provided, wherein an apparatus, illustrated as a deformable plug (26), is injected into the casing (14) of the hydrocarbon well (10). More specifically, a plurality of deformable plugs (26) are injected into the casing (14) upstream of the production zone (20) in conjunction with an injection fluid (F) pumped into the casing. The deformable plugs (26) can be injected into the interior portion (22) of the casing with any suitable deformable plug injector apparatus capable of injecting the deformable plugs downhole. In an embodiment, the deformable plugs can be injected into the interior portion (22) of the casing with a conventional ball sealer injector (not shown). A non-limiting example of a ball sealer injector that may be used is a ball sealer injector manufactured by Weir Oil & Gas of Houston, Tex. The number of deformable plugs used can vary depending on wellbore conditions and can be determined by one skilled in the art.

The injection fluid (F) may be any conventional fluid used by one of skill in the art in well stimulation. Non-limiting examples of fluids used include water, diesel, acid, viscosified fluids, and the like. The density of the fluid can range from about 0.7 g/cc to about 1.3 g/cc. Optionally, the density of the fluid can range from about 0.8 g/cc to about 1.2 g/cc. Optionally, the density of the fluid can range from about 0.9 g/cc to about 1.1 g/cc.

In an embodiment, the density of the deformable plug is greater than the density of the injection fluid. Optionally, the density of the deformable plug is less than or equal to the density of the injection fluid. In at least one embodiment, the density of the deformable plug can range from about 0.7 g/cc to about 1.3 g/cc. Optionally, the density of the deformable plug can range from about 0.8 g/cc to about 1.2 g/cc. Optionally, the density of the deformable plug can range from about 0.9 g/cc to about 1.1 g/cc. In an embodiment, a plurality of deformable plugs can be injected into the casing, wherein at least one deformable plug has a density differing from another deformable plug.

As shown in FIG. 2, when the deformable plugs (26) reach the production zone (20) including the perforations (18), the flow of the fluid (F) outwardly through the perforations will force the deformable plugs in that direction. If the production zone is not of uniform stress, the fluid will flow at a higher rate through the perforations adjacent to the portion of the production zone with the lowest stress. Thus, the fluid velocity will be highest through these high flow perforations, and the deformable plugs will be preferentially forced toward those particular perforations. As shown in FIG. 2, the flow of the fluid (F) through the perforations (18) adjacent to the lower stress portions (28) of the production zone (20) carries the deformable plugs (26) toward the perforations causing them to seat on and seal off the perforations. Once seated on the perforations, the deformable plugs are held onto the perforations by the fluid pressure differential that exists between the interior portion (22) of the casing and the production zone (20) adjacent to the casing (14).

The deformable plugs are sized and configured to collectively substantially seal off a production zone of the hydrocarbon well. In the embodiment illustrated, each deformable plug (26) is sized and configured to substantially seal a respective perforation (18) in the casing (14) of the well (10). In an alternate embodiment, a plurality of deformable plugs may collectively substantially seal an opening defined by the casing. In such an embodiment, the opening may be a perforation, a jetted hole or an opening defined by a sliding sleeve. The deformable plug may substantially seal or plug a perforation or opening by seating at least a portion of the deformable plug in the perforation or opening and deforming at least the portion seated in the perforation or opening to the contour of the perforation or opening. The deformation of the deformable plug may be due to the composition of the deformable plug, wherein the deformable plug is malleable for a certain period of time. In an embodiment the deformable plug is malleable for a time of less than 10 hours, optionally less than 5 hours, optionally for a time of less than 2 hours, optionally less than 1 hour. Optionally, the deformation of the deformable plug may be due to the composition of the deformable plug, wherein the deformable plug is malleable for a time of less than 1 hour when exposed to a temperature in the range of about 150° F. to about 300° F. Optionally, the deformation of the deformable plug may be due to the composition of the deformable plug, wherein the deformable plug is malleable for a period of time when the deformable plug contacts a fluid including water, acid, hydrocarbons, viscosified fluid, and the like.

In an alternate embodiment, at least a portion of the deformable plug initially deforms to the contour of the perforation or opening and swells, compresses, or hardens when a triggering external condition is introduced. A hydrocarbon based solution is injected into the casing contacting the deformable plug, wherein the deformable plug swells, compresses, or hardens. Optionally, a hydrocarbon based fluid is introduced in the casing concurrently with the deformable plug, wherein the deformable plug swells, compresses, or hardens when removed from contact with the hydrocarbon based fluid. Optionally, the deformable plug swells, compresses, or hardens when exposed to an elevated temperature. In an embodiment the deformable plug swells, compresses, or hardens when exposed to a temperature above ambient temperature. In an embodiment the deformable plug swells, compresses, or hardens when exposed to a temperature above the transporting fluid temperature (for example as the well heats up after the operations of pumping the deformable plugs and the plugs are in place in the perforations). In an embodiment the deformable plug swells, compresses, or hardens when exposed to a temperature above 100° F., optionally in the range of from 100° F. to 500° F., optionally in the range of about 150° F. to about 300° F. The deformable plug can swell, compress, or harden until the force exerted on the casing, cement, and/or production zone surrounding the deformable plug is less than the resistive force of the casing, cement, and/or production zone surrounding the deformable plug.

In an embodiment, at least a portion of the deformable plug initially deforms to the contour of the perforation or opening and, optionally, compresses, swells, or hardens when a triggering external condition is introduced. After a period of time, such as a non-limiting example of about 30 minutes to about 2 hours, the deformable plug enters a non-deformable state. The deformable plug is referred to as "set" at this point and is in a sealing relationship with the surrounding casing, cement, and/or formation such that the formation is no longer in fluid communication with the wellbore through the subject perforation. Optionally, the deformable plug enters a non-deformable state when exposed to an elevated temperature for a certain minimum period of time, such as in a non-limiting example at a temperature of about 150° F. to about 300° F. for a period greater than about 60 minutes. Optionally, the deformable plug enters a non-deformable state when exposed to a pressure of about 1,000 psi to about 5,000 psi for a period greater than about 60 minutes. Optionally, the deformable plug enters a non-deformable state when exposed to a hydrocarbon-based solution. Optionally, the deformable plug enters a non-deformable state when a hydrocarbon-based solution is removed from contact with the deformable plug for more than 60 minutes.

In an embodiment, the deformable plug is formed from an epoxy. In an alternate embodiment, the deformable plug is formed from a polymer. Optionally, the deformable plug is formed from syntactic foam with a polyurethane covering. In an embodiment, the deformable plug is formed from a malleable metal alloy. In another embodiment, the deformable plug is formed from an aluminum alloy, a lead alloy, a copper alloy, or combinations thereof. Optionally, the deformable plug is formed from organic material. In an embodiment, the deformable plug forms a hollow, spherical shape. Optionally, the deformable plug forms a solid core having a spherical shell covering the core.

Deformable plugs in accordance with the present invention are typically characterized by a substantially smooth surface and a substantially spherical shape, although other polygonal shapes can be used. Further, and in accordance with the present invention, the deformable plug can be manufactured in any desired diameter/size. In an embodiment, a substantially spherical deformable plug ranges from about ⅝" (about 1.58 cm) to about ⅞" (about 2.22 cm) in outer diameter. In another embodiment, a substantially spherical deformable plug ranges from about 0.2 inches (about 0.51 cm) to about 5.0 inches (about 12.7 cm) in outer diameter. Optionally, a substantially spherical deformable plug ranges from about 0.5 inches (about 1.27 cm) to about 2.0 inches (about 5.1 cm). Optionally, a substantially spherical deformable plug ranges from about 0.5 inches (about 1.27 cm) to about 1.5 inches (about 3.81 cm). As indicated above, while substantially spherical shapes have been specifically described, it will be apparent that other shapes consistent with oilfield operations and downhole geometry could be made and used in accordance with the present invention, including but not limited to polyhedrons (solids bounded by a finite number of plane faces, each of which is a polygon) such as "regular polyhedrons (tetrahedrons, hexahedrons, octahedrons, decahedrons, dodecahedrons, and icosahedrons), as well as non-regular polyhedra such as those polyhedrons consisting of two or more regular polyhedrons (e.g., 2 regular tetrahedrons), and semi-regular polyhedrons (those that are convex and all faces are regular polyhedrons), as well as well-known polyhedra such as pyramids.

The various embodiments of the deformable plug described herein are highly suitable for use in most wells (shallower than 25,000 ft.) where bottom hole hydrostatic pressures during the employment of the methods disclosed herein will generally be in the range of about 8,000 to about 13,000 psi and temperatures in the range of about 100° F. (38° C.) to about 350° F. (177° C.). Also, the pressure differential across each of the perforations ranges from about 1,000 psi to about 10,000 psi. Optionally, the operation differential pressure ranges from about 1,000 psi to about 5,000 psi. In an exemplary embodiment, the deformable plugs are implemented when the temperatures are in the range of about 150° F. to about 300° F. with hydrostatic pressures exceeding 10,000 psi and differential pressures exceeding 1,500 psi.

Figure 3:
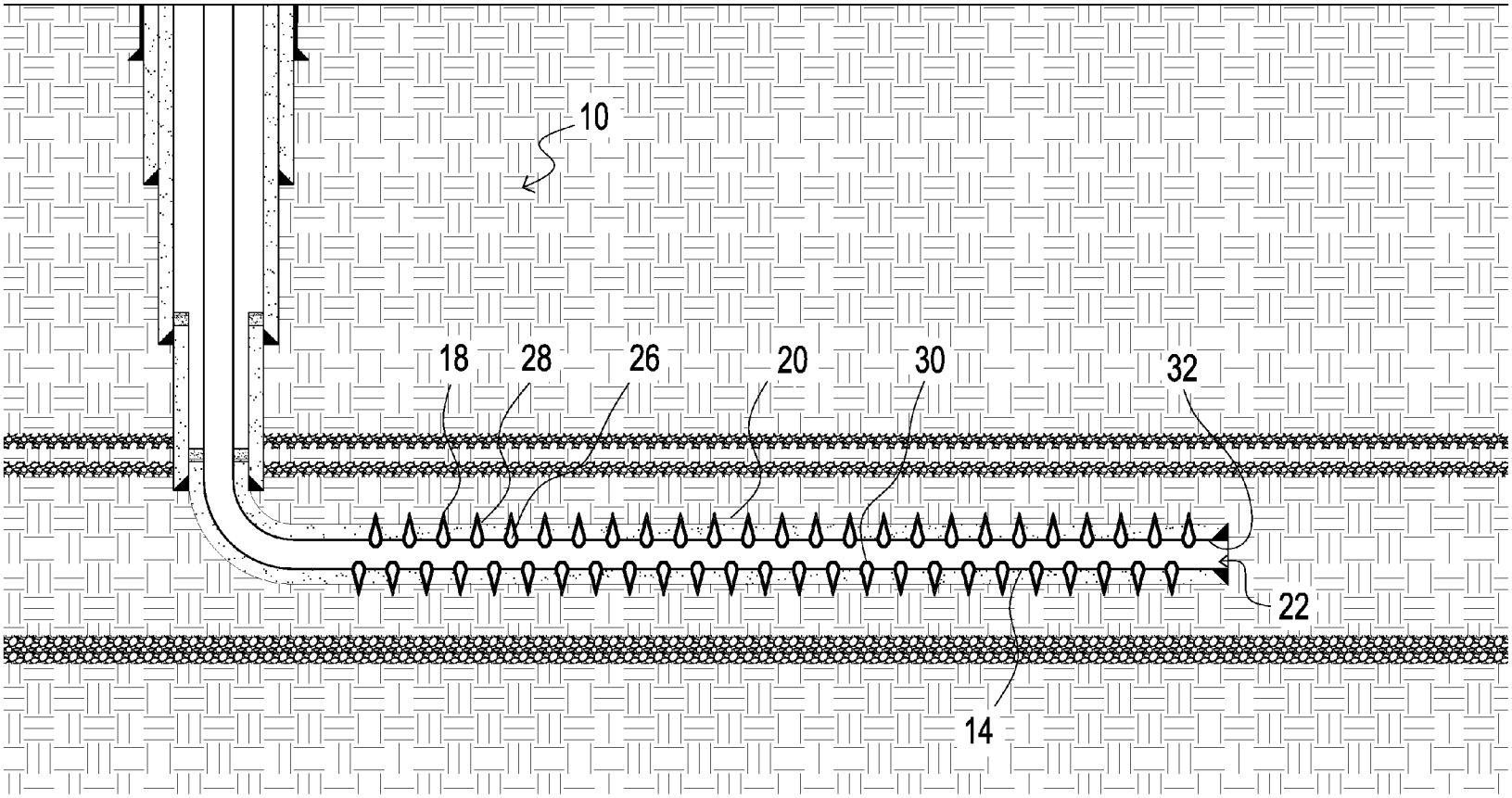
FIG. 3 illustrates a cross-sectional view of a wellbore, wherein the production zone has been substantially sealed off with a plurality of deformable plugs consistent with an embodiment of the present invention.

Looking now at FIG. 3 and as shown in FIG. 2 and discussed above, the perforations (18) adjacent to the lower stress portions (28) of the production zone (20) are initially substantially sealed by respective deformable plugs (26). The increase in pressure in the wellbore causes the fluid to flow through the perforations adjacent to the higher stress portions of the target formation and carries the deformable plugs toward the perforations adjacent to such perforations causing them to seat on the perforations. This process continues until substantially all of the perforations (18) are substantially sealed by the deformable plugs (26), thereby substantially sealing the productions zone (20) as shown in FIG. 3. As the deformable plugs are introduced into the casing, the fluid flow urges the deformable plugs through the casing and toward the perforations. The operator can inject more deformable plugs in the casing than needed to substantially seal off the production zone.

In an embodiment, at least a portion of the deformable plug (26) substantially seals or plugs a perforation. As illustrated in FIG. 3, a remaining portion (30) of the deformable plug (26) extends outwardly from the perforation (18) and interior wall (32) of the casing and into the interior portion (22) or cavity formed by the casing (14). A plug ratio may be calculated based on the plugged portion of the deformable plug versus the remaining portion of the deformable plug. The plug ratio can vary depending on well specific conditions, such as for example, shape and size of the perforations, pressures, and temperatures within the wellbore. Additionally, the formation characteristics, e.g., pressure, temperature, and composition, can affect the plug ratio. Further, the characteristics of the deformable plug, e.g., size and composition, can also affect the plug ratio. In an embodiment, the plug ratio of the plugged portion:remaining portion is about 5:1. In an alternate embodiment, the plug ratio is about 3:1. Optionally, the plug ratio is about 1:1. Optionally, the plug ratio is about 1:2. Optionally, the plug ratio is about 1:3. The plug ratio can be perforation specific and may vary depending on each perforation in the production zone.

As shown in FIG. 3, the production zone (20) of the well is substantially sealed off. The production zone (20) is no longer in fluid communication with the interior cavity (22)

of the casing (14). The casing in the production zone is returned to a substantially sealed environment with respect to the surrounding formation and to a condition similar to the condition of the well prior to perforating the production zone, except for the remaining portions of the respective deformable plugs extending outwardly from the inner surface of the casing.

Figure 4:
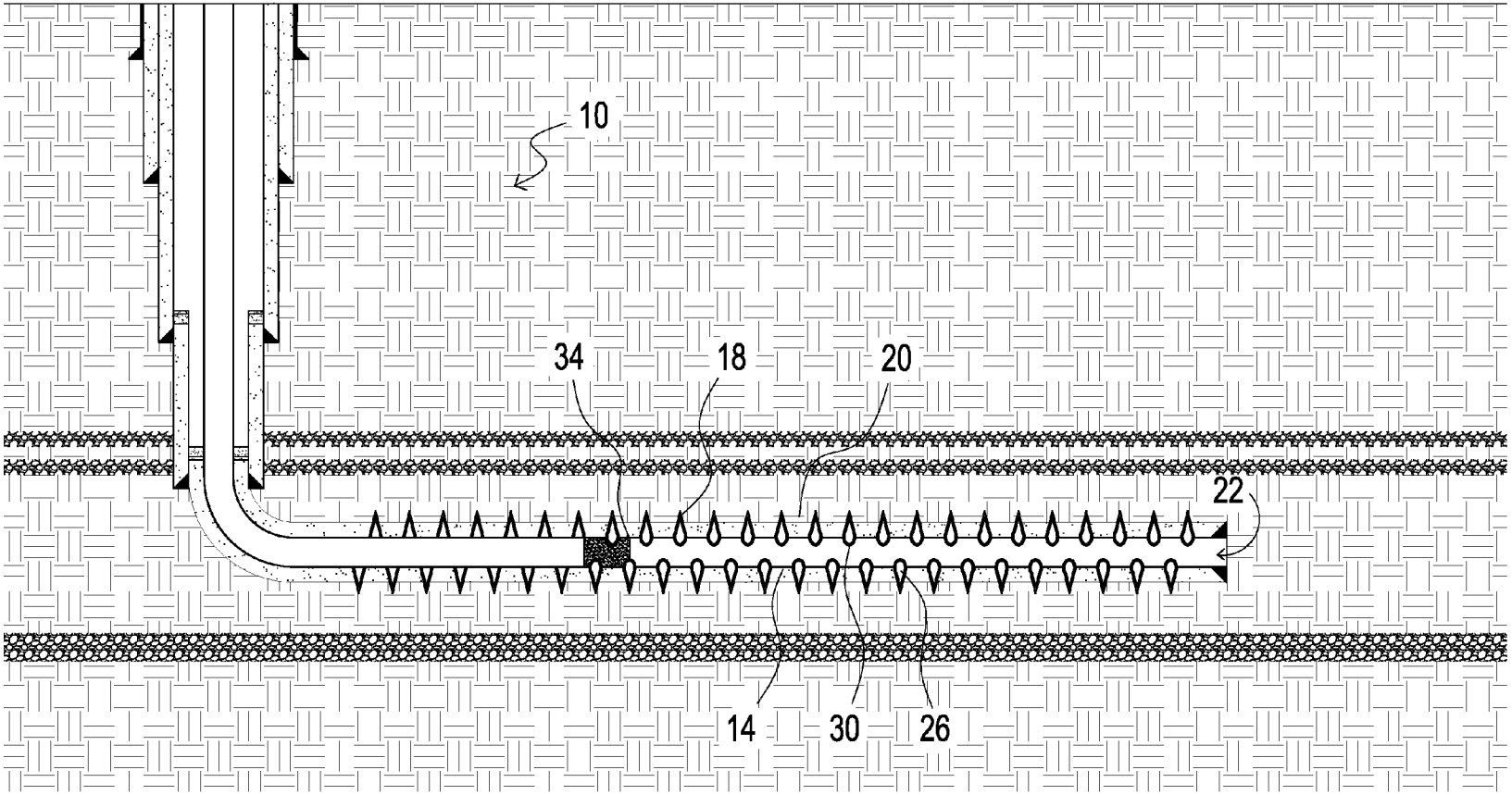
FIG. 4 illustrates a cross-sectional view of a wellbore, wherein a cutting tool is being utilized to return the inner diameter of the casing in the production zone of the wellbore to the initial inner diameter prior to perforating or re-perforating the production zone.

FIG. 4 illustrates an embodiment of the present invention, wherein a cutting tool (34) is used to return the inner diameter of the casing (14) to the initial state of the casing prior to the perforation (18) of the portion of the casing in the production zone (20). More specifically, a cutting tool (34), illustrated as a scraper, is run into the interior cavity (22) of the casing (14). The scraper can have a scraping surface sized and configured to remove any protrusions from the interior surface of the casing. In an embodiment shown in FIG. 4, the scraper (34) is run into the interior cavity (22) of the casing (14) and removes the remaining portion (30) of each deformable plug (26) seated in a respective perforation (18) in the production zone (20). A non-limiting example of a suitable casing scraper is a casing scraper manufactured by Texas International Oilfield Tools, LTD of Houston, Tex. Optionally, the cutting tool may be run on the end portion of a drill string. Non-limiting examples of cutting tools include scrapers, reamers, bits, and the like.

Alternatively, in an embodiment, a flattening device is used to return the inner diameter of the casing to the initial state of the casing prior to the perforation of the portion of the casing in the production zone. The flattening device can have a surface sized and configured to flatten any protrusions against the interior surface of the casing, thereby sealing the perforations. In an embodiment, the flattening device is run into the interior cavity of the casing and flattens the remaining portion of each deformable plug seated in a respective perforation in the production zone against the interior surface of the casing. A non-limiting example of a suitable flattening device is a casing swage manufactured by Crossover, Inc of Harvey, LA.

Figure 5:
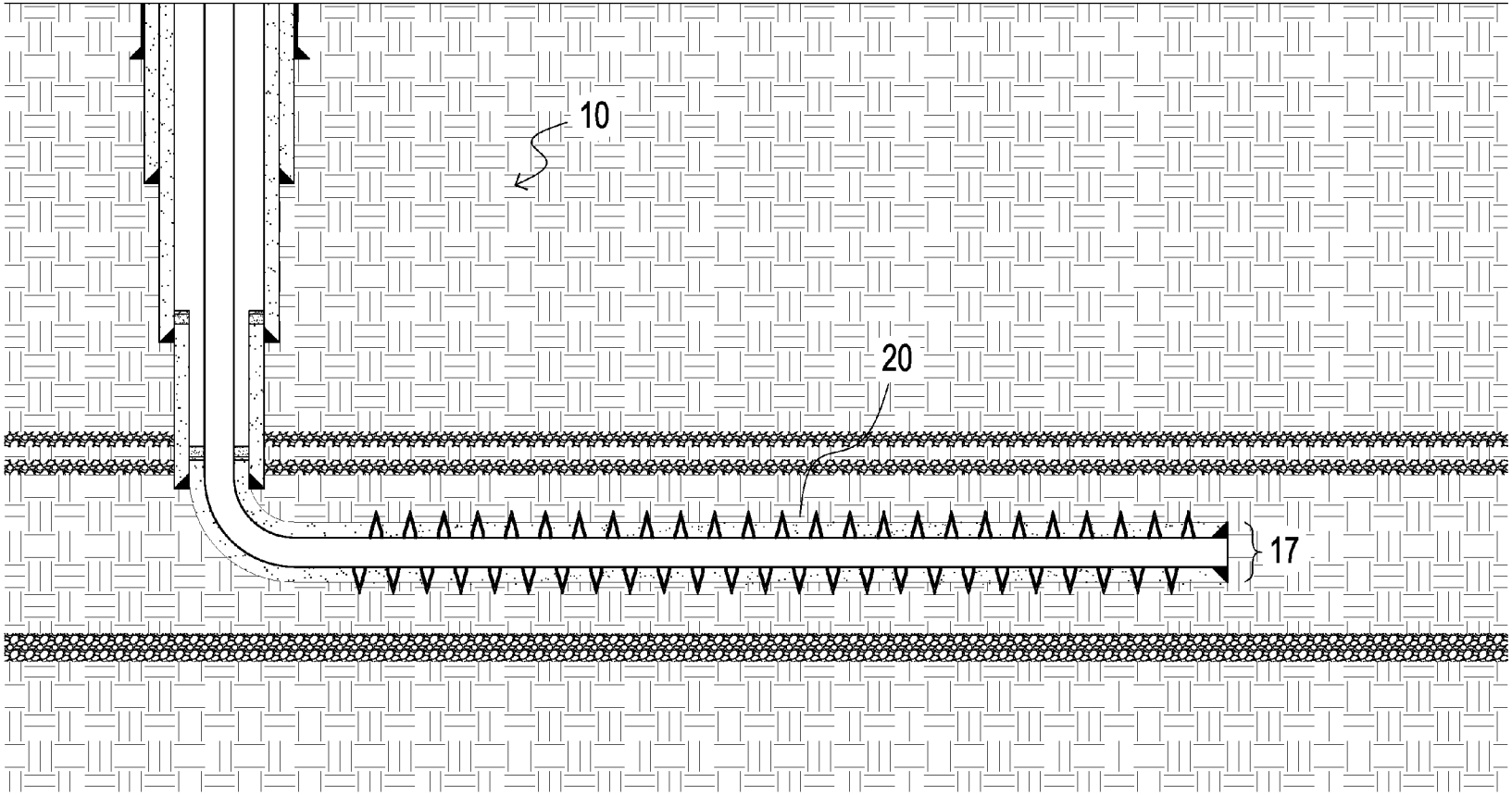
FIG. 5 illustrates a cross-sectional view of a wellbore, wherein the production zone of the wellbore has been substantially sealed off consistent with an embodiment of the present invention.

As illustrated in FIG. 5, the cutting tool has been removed from the wellbore (17) and the original wellbore integrity has been returned to the hydrocarbon well (10) having the production zone (20) substantially sealed off. The operator of the hydrocarbon well can choose to re-complete and/or re-stimulate the production zone. The operator may choose to re-fracture the production zone after perforating the production zone. Alternately, the operator may choose to select a new target formation containing hydrocarbons. The operator may perforate a new target formation creating a new production zone.

In an embodiment the deformable plugs can be constructed in a manner where they can optionally be removable. In an embodiment the deformable plugs contain material that breaks down over time, thus providing a substantially sealed perforation for a limited period of time. In an embodiment the deformable plugs contain material that breaks down upon contact with a triggering material, such as upon contact with acid, thus providing a substantially sealed perforation until contacted by acid.

Optionally, the operator may stimulate the production zone with new perforations and a treatment such as fracturing. After treatment of the new perforations the older perforations may be reopened by treating the perforations substantially sealed by the deformable plugs, such as by acidizing. The deformable plugs may be configured, such that the sealing relationship between the deformable plug and the respective perforation is substantially reduced when the acid contacts the deformable plug. In such an embodiment, the operator may produce from the original perforations in addition to the new perforations.

The term "deformable," as used herein, means capable of being deformed or put out of shape. For example, the deformable plug may be deformed when its shape is no longer spherical, such as when it deforms to assume the contour of a perforation. It is an indication that the deformable plug shape is flexible.

The term "substantially sealing," as used herein, means to seal a perforation or other opening. The perforation can be considered substantially sealed if it is at least 95 percent sealed. This can be estimated in a lab environment by measuring the size of an indentation and the size of a diameter of perforation. Also, visual tests in a lab environment can be used to estimate that no fluid flows into a perforation.

The term "stimulation", as used herein, refers to productivity improvement or restoration operations on a well as a result of a hydraulic fracturing, acid fracturing, matrix acidizing, sand treatment, or other type of treatment intended to increase and/or maximize the well's production rate or its longevity, often by creating highly conductive reservoir flow paths.

Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

The various aspects of the present invention can be joined in combination with other aspects of the invention and the listed embodiments herein are not meant to limit the invention. All combinations of various aspects of the invention are enabled, even if not given in a particular example herein.

While illustrative embodiments have been depicted and described, modifications thereof can be made by one skilled in the art without departing from the spirit and scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.).

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Also, it is within the scope of this disclosure that the aspects and embodiments disclosed herein are usable and combinable with every other embodiment and/or aspect disclosed herein, and consequently, this disclosure is enabling for any and all combinations of the embodiments and/or aspects disclosed herein.

While the foregoing is directed to embodiments of the present invention, other and further embodiments of the invention may be devised without departing from the basic scope thereof and the scope thereof is determined by the claims that follow.

What is claimed is:

1. A system for substantially sealing one or more openings defined by a hydrocarbon well downhole component, wherein an interior portion of the downhole component is in fluid communication with a formation surrounding the hydrocarbon well, the system comprising:

a deformable plug adaptable to being injected into the wellbore upstream of the opening and carried through the wellbore in a fluid;

wherein the fluid carrying the deformable plug can flow through the opening and the deformable plug being sized and configured such that at least a portion of the deformable plug can deform to the contour of the opening and seat in the opening;

wherein the deformable plug is capable of hardening, swelling, or compressing such that the deformable plug forms a substantially sealed relationship with the hydrocarbon well downhole component such that the interior portion of the hydrocarbon well downhole component ceases to be in fluid communication with the formation surrounding the well;

a deformable plug injector sized and configured to inject a plurality of deformable plugs into the hydrocarbon well downhole component;

a fluid pumping source sized and configured to pump the fluid at a sufficient rate to carry the plurality of deformable plugs downhole so that one or more of the plurality of deformable plugs can seat in the opening defined by the hydrocarbon well component and form a substantially sealed permanent relationship with the hydrocarbon well downhole component; and a cutting tool sized and configured to sever the remaining portion of the deformable plug not seated in the opening such that the inner diameter of the casing is substantially uniform, wherein the portion of the deformable plug disposed within the opening remains and forms a permanent seal such that the interior portion of the hydrocarbon well downhole component ceases to be in fluid communication with the formation surrounding the well.

2. The system of claim 1, further comprising a ball catcher sized and configured to retrieve one or more deformable plugs in the wellbore.

3. The system of claim 1, wherein the deformable plug has a composition selected from the group consisting of polymers, syntactic foam, malleable metal alloy, organic material, and combinations thereof, and the deformable plug has a density of about 0.7 g/cc to about 1.3 g/cc and an outer diameter of about 0.5 inches to about 1.5 inches.

4. A method for substantially sealing at least one opening defined by a hydrocarbon well downhole component, wherein an interior portion of the hydrocarbon well downhole component is in fluid communication with a formation surrounding the hydrocarbon well, the method comprising:

injecting at least one deformable plug into the interior portion of the hydrocarbon well downhole component;

pumping a fluid from a fluid pumping source into the interior portion of the hydrocarbon well downhole component, such that the fluid carries the deformable plug as the fluid flows through the opening and the deformable plug seats in the opening defined by the hydrocarbon well downhole component, at least a portion of the deformable plug (i) deforming to abut substantially all of the contour of the opening, and (ii) rigidly setting in a substantially sealing relationship with the hydrocarbon well downhole component, wherein a portion of the deformable plug disposed within the opening forms a substantially sealed permanent relationship such that the interior portion of the hydrocarbon well downhole component and the formation surrounding the wellbore are no longer in fluid communication; and severing the portion of the deformable plug extending into the interior portion of the hydrocarbon well downhole component such that the inner diameter of the hydrocarbon well downhole component is substantially uniform, wherein the portion of the deformable plug disposed within the opening remains and forms a permanent seal such that the interior portion of the hydrocarbon well downhole component ceases to be in fluid communication with the formation surrounding the well.

5. The method of claim 4, wherein the deformable plug has a composition selected from the group consisting of polymers, syntactic foam, malleable metal alloy, organic material, and combinations thereof, and the deformable plug has a density of about 0.7 g/cc to about 1.3 g/cc and an outer diameter of about 0.5 inches to about 1.5 inches.

6. The method of claim 4, wherein the deformable plug further swells, hardens, or compresses in response to an external condition such that the seated portion of the deformable plug is projected against and abuts the contour of the opening defined by the hydrocarbon well downhole component and a portion of the deformable plug is disposed within the opening thereby forming a substantially sealed permanent relationship with the hydrocarbon well downhole component.

7. The method of claim 4, wherein the hydrocarbon well downhole component is selected from the group consisting of casing, tubing, and liner.

8. The method of claim 4, wherein the hydrocarbon well component is casing and the opening defined by the casing is a perforation formed from the discharge of a perforation device.

9. A method for substantially sealing off a production zone in a hydrocarbon well comprising casing and cement surrounding the casing, the method comprising:

introducing a plurality of deformable plugs into an interior portion of the casing, at least one deformable plug comprising a composition selected from the group consisting of polymers, syntactic foam, malleable metal alloy, organic material, and combinations thereof, and the deformable plug having a density of about 0.7 g/cc to about 1.3 g/cc and an outer diameter of about 0.5 inches to about 1.5 inches;

pumping a fluid from a fluid pumping source into the interior portion of the casing, so that the fluid carries the deformable plugs as the fluid flows into a plurality of perforations defined by the casing and cement;

wherein at least a portion of at least one deformable plug seats in a respective perforation and deforms to form the shape of the contour of the perforation and further swells, hardens, or compresses to form a substantially sealing relationship with a portion of casing surrounding the perforation and a remaining portion of the deformable plug extends outwardly into the interior portion of the casing;

wherein the seated deformable plug has a plug ratio (plugged portion : remaining portion) of at least 1:3; and severing the remaining portion of the deformable plug extending outwardly into the interior portion of the casing, wherein the portion of the deformable plug disposed within the opening remains and forms a permanent seal such that the interior portion of the hydrocarbon well downhole component ceases to be in fluid communication with the formation surrounding the well, whereby an initial pressure in the hydrocarbon well is recovered.

10. The method of claim 9, wherein the composition of the deformable plug swells, hardens, or compresses in response to an external condition such that the seated portion of the deformable plug is projected against and abuts the contour of the perforation defined by the casing and cement thereby forming a substantially sealed permanent relationship with the portion of the casing defining the perforation.

11. The method of claim 10, wherein the plurality of deformable plugs are introduced into the interior portion of the casing by a ball sealer injector.

12. The method of claim 10, wherein the seated deformable plug has a plug ratio of the plugged portion : remaining portion that ranges from 1:3 to 5:1.

* * * * *